US005685365A

United States Patent [19]

De'Longhi

[11] Patent Number: 5,685,365

[45] Date of Patent: Nov. 11, 1997

[54] RADIATOR FOR HEATING ROOMS

[75] Inventor: Giuseppe De'Longhi, Treviso, Italy

[73] Assignee: De' Longhi S.p.A., Treviso, Italy

[21] Appl. No.: 587,667

[22] Filed: Jan. 17, 1996

[30] Foreign Application Priority Data

Jan. 20, 1995 [IT] Italy ..... MI95U0031

[51] Int. Cl.[6] ..... F24H 3/00

[52] U.S. Cl. ..... 165/135; 165/130; 165/134.1; 165/170; 392/378

[58] Field of Search ..... 165/129, 130, 165/134.1, 135, 170; 392/378

[56] References Cited

U.S. PATENT DOCUMENTS

| | | | |
|---|---|---|---|
| 2,651,506 | 9/1953 | Lehmann | 165/130 |
| 3,650,321 | 3/1972 | Kaltz | 165/106 |
| 5,341,455 | 8/1994 | De Longhi | 392/378 |

FOREIGN PATENT DOCUMENTS

| | | | |
|---|---|---|---|
| 6 530 674 | 8/1975 | Australia . | |
| 75 621 | 4/1959 | France . | |
| 1 394 844 | 2/1964 | France . | |
| 2440184 | 3/1976 | Germany | 165/129 |
| 2 275 005 | 8/1994 | United Kingdom . | |
| 694 743 | 1/1996 | United Kingdom . | |

*Primary Examiner*—Allen J. Flanigan
*Attorney, Agent, or Firm*—Herbert Dubno; Yuri Kateshov

[57] ABSTRACT

Radiator, particularly for heating rooms, including a main body defined by several radiating elements (3) having hot fluid flowing therein, each of the radiating elements being defined by at least a first and second sheet elements (6,7) having a plurality of apertures (9) for reducing the temperature on the external perimetric surface of the radiating elements; at least one of the apertures (10), besides the reduction of the temperature on said external surface, prevents the deformation of the sheet of the radiating elements while welding together the first and second sheet elements.

10 Claims, 3 Drawing Sheets

RADIATOR FOR HEATING ROOMS

FIELD OF THE INVENTION

The present invention relates to a radiator, particularly for heating rooms.

BACKGROUND OF THE INVENTION

As known, radiators for heating rooms in a building are usually made of an array of radiating elements containing a hot fluid such as, for example, diathermic oil, heated by an electric resistance.

The propagation of heat in those type of radiators is effected in substantially two ways: by conduction and by convection.

The heat propagation by conduction occurs mainly between the radiator internal surfaces which are in contact with the hot diathermic oil and the external surfaces which, although at a distance from the diathermic oil, reach the same temperature of the oil in a short time.

The propagation of heat by convection entails the passage of heat from the hot surface of radiator to the surrounding air particles.

It is apparent from the above that the superficial temperature of the conventional radiators is practically equal to the temperature of the hot fluid (diathermic oil) circulating inside the radiator.

For the above reason the superficial temperature of an oil radiator might be so high to cause the burning of the skin if the user accidentally touches the radiator.

To prevent such occurrence, regulations provide that the superficial temperature of an oil radiator should not exceed a certain value.

In order to keep the superficial temperature below said values it is possible to lower the temperature of the diathermic oil circulating inside the radiator with the obvious consequence of reducing the heating capacity of the radiator.

Since it was not possible to lower the oil temperature, thermal cuts have been provided along the surface of the radiating elements of the radiator to make the temperature of the radiator external surface comply with the statutory limits.

Once this problem was solved a further inconvenience occurred. In order to reduce the manufacturing costs of the radiators each element is manufactured in line by welding two sheets by means of automatic machines provided with welding rollers which, for welding the sheets, follow a path that goes from the upper hub of the radiator to the lower hub of the radiator turning around the hubs.

The welding operation causes the temperature of the metal sheet to rise sharply at the weld, while the sheet tends to heat considerably less at a distance from the weld.

This fact determines a different expansion of the sheet which may bend or warp causing the rejection of the radiating element, with all the consequences of discarding a product.

In particular, this is more likely to occur when the weld region of the first and second sheet members is at a greater distance from the edges of the radiator elements.

A further important inconvenience of the oil radiators is, for example, that of the connection between the edges of the first and second sheet members of each radiating element.

In fact, this connection is presently performed also with a welding operation using welding rollers. The welding operation raises the manufacturing costs of the radiator and entails further finishing operations on the welded surfaces, such as deburring, brushing and buckling, before painting the radiator.

Further to the above, when the first and second sheet members, constituting the radiating element, are welded together at the edges, besides a deformation of the material, their edges are slightly spread apart forming two blades that can be extremely dangerous in case of contact.

Furthermore, one of the edge may be staggered with respect to the other one because of assembly defects or of asymmetrical deformations due to the welding operation.

Substantially the same inconveniences occur also on the edges of the apertures provided for the reduction of the temperature of the external surface of the radiator.

OBJECTS OF THE INVENTION

The principal object of the present invention is to provide a radiator without the above described drawbacks. Still another object of the invention is to provide the radiator having external surface temperature to be considerably less than the temperature of the diathermic oil circulating inside the radiator without thereby reducing the efficiency of the radiator. Another object of the invention is to provide the radiator wherein during manufacturing of the radiating elements, any unwanted deformation of the metal sheet, that may cause the rejection of the finished product, is prevented.

Still another object of the invention is to provide the radiator which is economic because each radiating element is manufactured by an in line welding of a first and second sheet members with automatic machines and therefore with sensibly reduced time and cost without the inconvenience of deformations of the radiating element sheet metal due to the difference of temperature caused by the welding operation.

A further object of the present invention is to provide a radiator wherein the edges of the first and second sheet elements are joined by folding their ends with one operation substantially along the perimeter of each radiating element.

A further object of the present invention is to provide a radiator wherein the joint between the edges of the first and second sheet elements defines a stiffening perimetric region of the radiator.

Still a further object of the present invention is to provide a radiator wherein the edges of the apertures, which are adapted to reduce the temperature, are not welded or just joined together but are pressed and drawn for obtaining an effective cold joint of the edges.

Still another object of the invention is to provide a radiator, for the same temperature of the diathermic oil of a conventional oil radiator but wherein heat exchange by convection much higher that the conventional radiator.

SUMMARY OF THE INVENTION

The above aim and objects are achieved by a radiator, particularly for heating rooms, comprising a main body defined by several radiating elements having hot fluid flowing therein, each of said radiating elements being defined by at least a first and second sheet elements having a plurality of apertures for reducing the temperature on the external perimetric surface of said radiating elements characterized in that at least one of the apertures, besides the reduction of the temperature on said external surface, prevents the deformation of the sheet of said radiating elements while welding together said first and second sheet elements.

BRIEF DESCRIPTION OF THE DRAWING

Further characteristics and advantages of the invention will be more apparent by the following description of the radiator according to the invention illustrated, by way of the enclosed drawings wherein.

SPECIFIC DESCRIPTION

Figure 1:
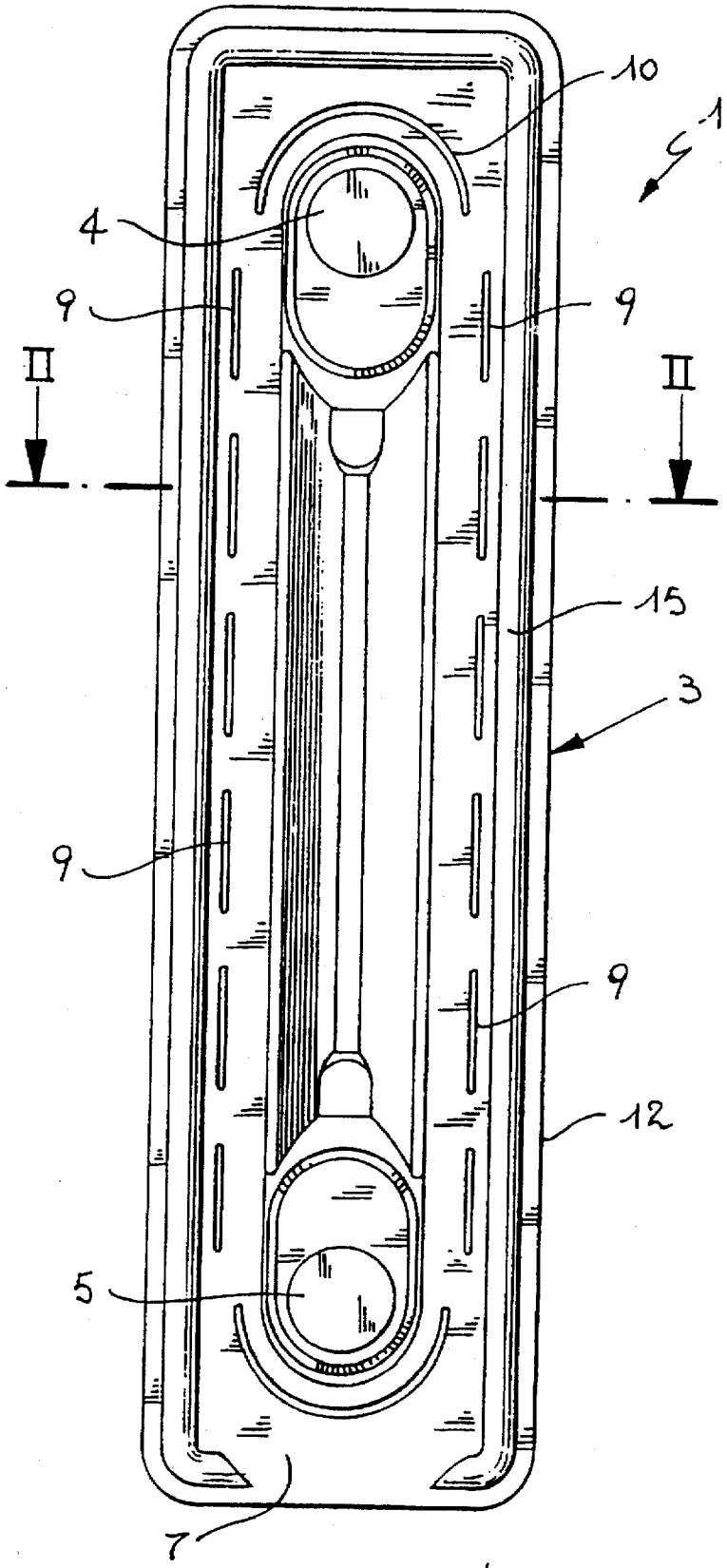
FIG. 1 is a front elevated view of a radiating element of the radiator according to the invention.

With particular reference to the above figures, the radiator for heating rooms, according to the invention, generally designated by the reference numeral 1, comprises a main body defined by several radiating elements each generally designated by the reference numeral 3.

Each radiating element has an upper hub 4 and a lower hub 5 for connecting together the radiating elements.

Figure 2:
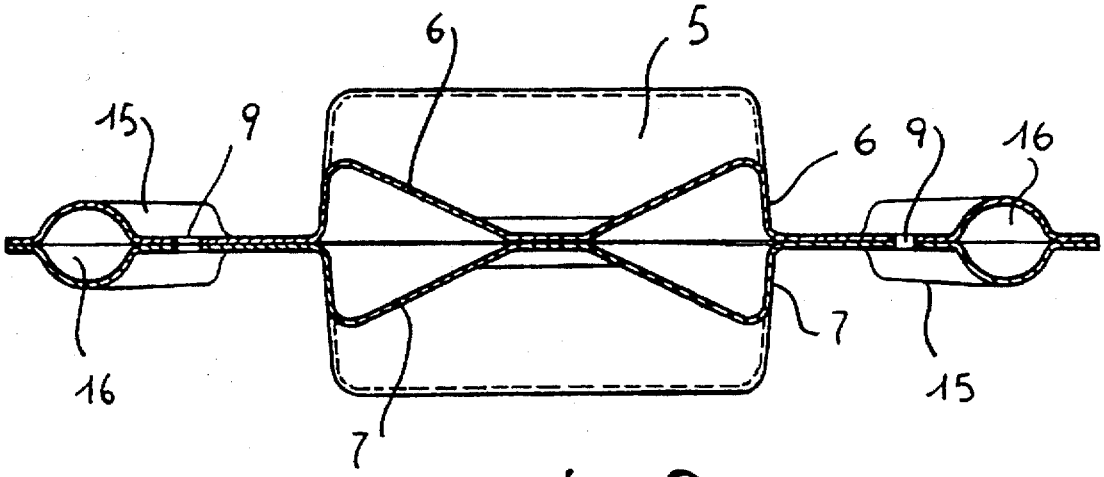
FIG. 2 is a is a section view taken along the line II—II of FIG. 1, according to the invention.
Figure 3:
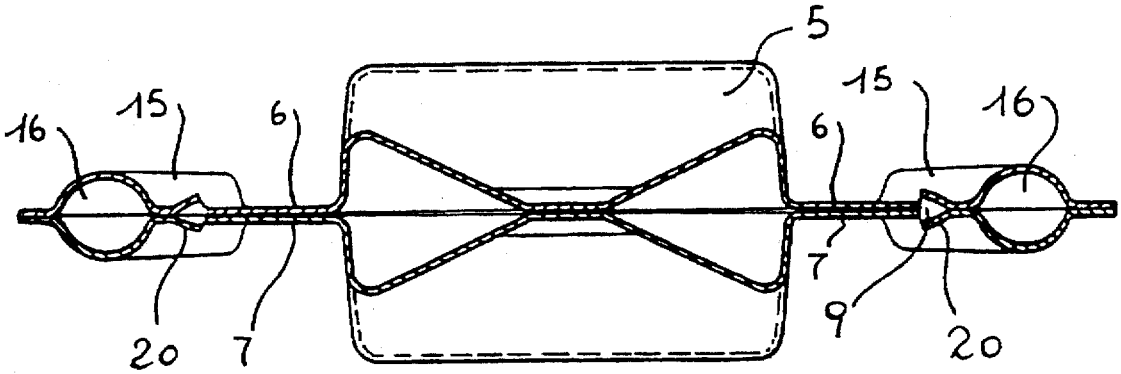
FIGS. 3 and 4 are section views of two further embodiments of the radiating elements according to the invention.
Figure 4:
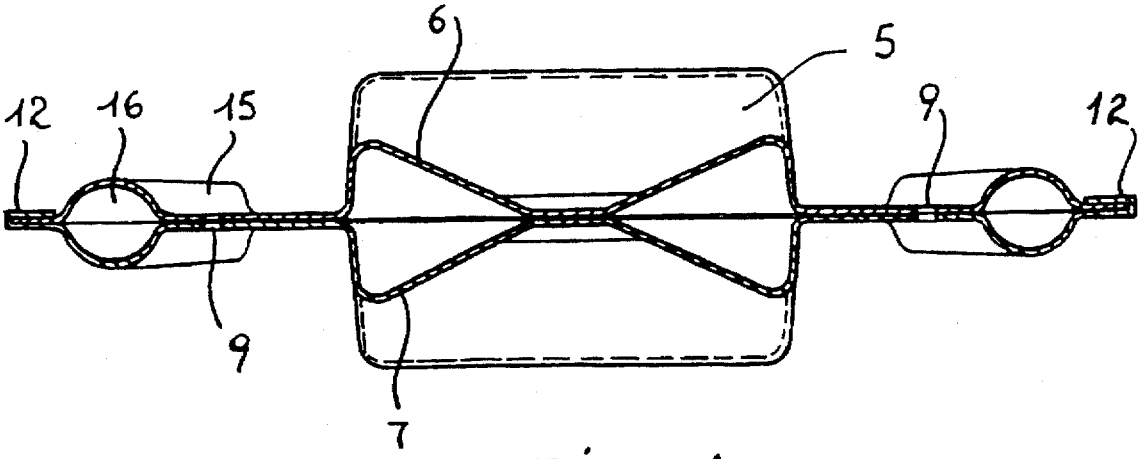
Figure 5:
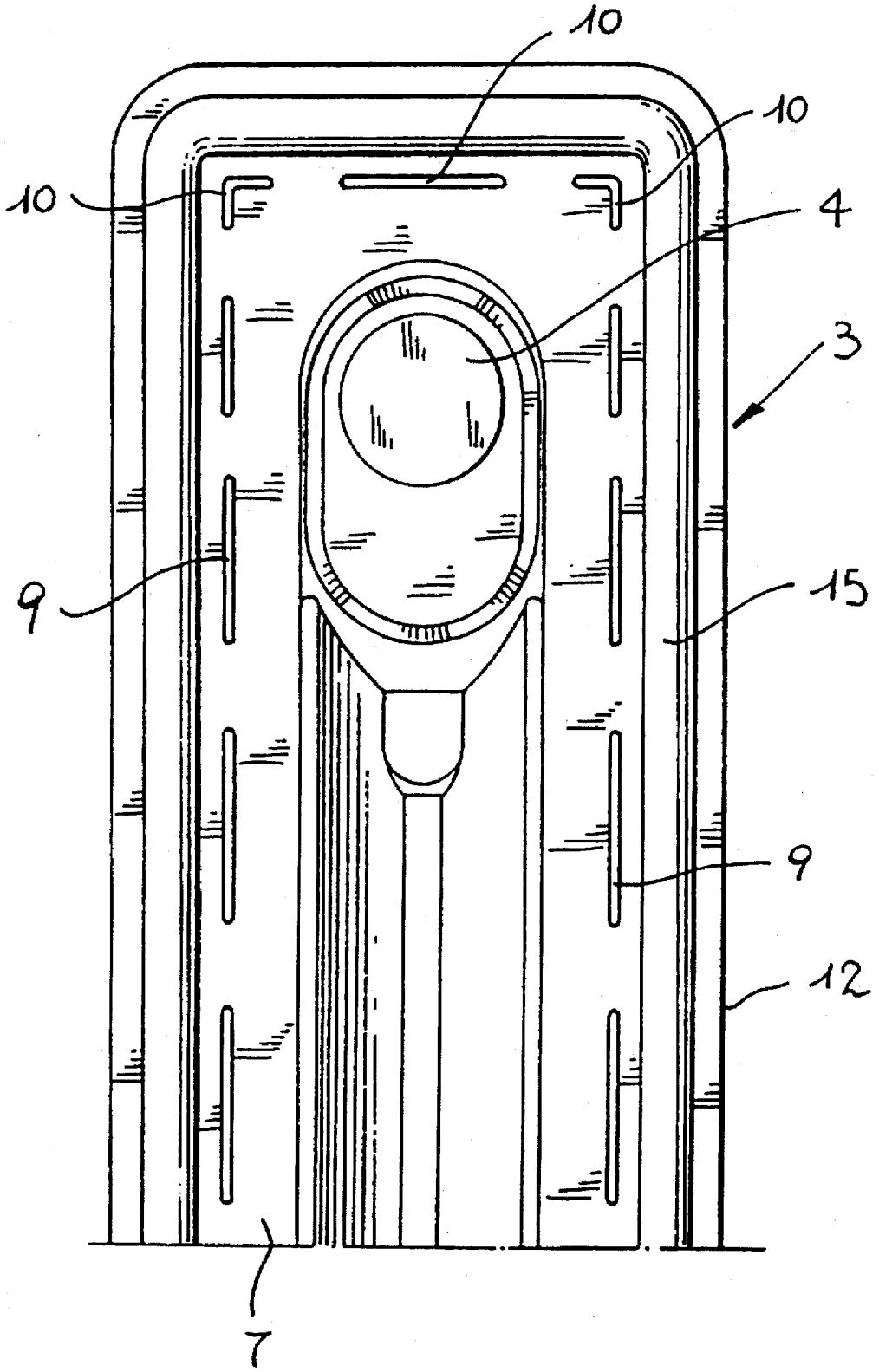
FIG. 5 is a partial view of a variated embodiment of the invention.

As shown in FIGS. 2, 3 and 4, each radiating element is defined by joining a first and a second sheet elements 6 and 7, by welding.

Namely, the first and second sheet elements, 6 and 7, are welded together along the path around the hubs, followed by the welding rollers of an automatic machine, not shown in the drawings, from the lower hub to the upper hub and back.

Each radiating element further has a plurality of apertures 9 adapted to lower the temperature on the external perimetric surface of the radiating elements with respect of the diathermic oil flowing inside the elements.

The apertures can also be provided with deflecting members 20 seen in FIG. 3.

Advantageously, at least one of the apertures, designated by the reference numeral 10, besides reducing the temperature on the external surface of the radiator, prevents the deformation of the sheet metal of the radiating elements while the first and second sheet elements 6 and 7 are welded together.

In fact, the aperture 10 defines an effective thermal cut adapted to absorb deformations of the sheet metal possibly generated by the overheating of the sheet metal while the first and second sheet elements are welded together.

More particularly, the aperture 10 is located in a region of each radiating element proximate to at least the upper hub 4.

Preferably, the aperture 10 is located proximate to the round weld region which is parallel to the surface of the upper hub 4.

In a preferred embodiment, as shown in FIG. 1, the aperture 10 lies parallel to the round weld region of the upper hub but, in different embodiments, may lie parallel to one of the sides of the radiating elements with the same effect of thermal cut and thereby preventing the deformation of the sheet metal while the first and second sheet elements 6 and 7 are welded together.

According to a further embodiment, the aperture 10 can be divided into a plurality of apertures and may lie parallel to the round weld region and at the same time parallel to at least one of the sides of the radiating element.

It is also to be noted that each radiating element 3 has a ridge or channel 15 lying substantially along its entire perimeter.

Ridge or channel 15 provides at least two important advantages.

The first advantage is that ridge 15 stiffens the radiating elements which are thereby more resistant to possible unwanted flexions due to impacts or other causes.

The second advantage is due to the fact that ridge 15 defines an air chamber 16 which increases the surface of the radiating element, with the consequent increase of heat exchange and therefore of the efficiency of the radiator, and, at the same time, and which gives a possible second thermal cut which further cools down the external perimetric surface of the radiator and maintains a higher temperature of the diathermic oil circulating inside the radiator.

The exchange surface between the radiator and the surrounding air is further increased by deflector members 20 provided at the lateral apertures of the radiating elements adapted to provide more thermal cuts.

Furthermore, as shown in FIG.4, the end 12 of each radiating element can be flanged to further stiffen the radiating element and to ensure a perfect association between the first and second sheet elements defining the radiating element.

Namely, the folding of the first and second sheet elements 6 and 7 can be effected by simply folding both edges of the elements by 180° in order to obtain a perimetric portion having a thickness substantially equal to four times the thickness of the sheet metal of each sheet element.

In a preferred embodiment the folding operation is effected by folding the edge of only one sheet element 6 or 7 which, in this solution, has a width greater than that of the associated sheet element.

In this manner, as clearly shown in FIG. 4, the 180° folding of the edge of only one sheet element defines a a perimetric portion having a thickness substantially equal to three times the thickness of the sheet metal of each sheet element.

Advantageously, the edges of apertures 9 and/or 10 are pressed and drawn in order to obtain an effective and economical cold mechanical joining between them.

This solution also allows to increase the joining force between the first and second sheet elements 6 and 7.

It should also be noted that with this solution the edges of the apertures are not sharp and perfectly aligned and provide a further stiffening of the radiating elements 3 and a perfect flatness of the elements.

The operation of the radiator according to the invention is already apparent from what has been described and illustrated above.

It has been seen in practice how the radiator according to the invention is particularly advantageous for preventing the deformation of the sheet metal, while welding each radiating element, and also for lowering the external temperature of the radiator within the limits set by the regulations while at the same time ensuring a high efficiency of the radiator and a limited manufacturing cost.

The materials employed, as well as the dimensions, may be any according to the specific needs and the state of the art.

We claim:

1. A radiator comprising:

a plurality of elongated upright radiating elements connected to one another in succession, each of said elements comprising:

a pair of sheets each having an upper and a lower hub defining respective openings and communicating with fluid passages formed in the respective radiating element, said sheets of each radiating element being welded together around each of said hubs and along a path which defines a passage extending between said hubs; and deformation means for reducing temperature along perimeters of said radiating elements including apertures formed between said hubs and said perimeters, at least one of said apertures being an arcuate aperture located in a deformation sensitive region around said upper hub for preventing deformation of said sheets upon welding of said sheets around said hubs.

2. The radiator defined in claim 1 wherein another arcuate aperture is located below the lower hub of the respective radiating element.

3. The radiator defined in claim 2 wherein additional apertures are located between the hubs.

4. The radiator defined in claim 3 wherein said additional apertures are formed along parallel longitudinal sides of the respective radiating element.

5. The radiator defined in claim 1 wherein the radiating element is further formed with a ridge extending substantially along the perimeter of the respective radiating element.

6. The radiator defined in claim 5 wherein said ridge defines an air chamber of the respective radiating element.

7. The radiator defined in claim 1 wherein said deformation means further comprises at least one heat deflector.

8. The radiator defined in claim 1 wherein each of said pair of sheets of the respective radiator is formed with a respective edge defining the respective perimeter.

9. The radiator defined in claim 8 wherein the edge of one of the sheets of the pair of sheets is folded over the edge of the other sheet of the respective radiating element, so that a resulting edge of the respective radiating element is thrice as thick as the edge of each sheet of the pair of sheets.

10. The radiator defined in claim 8 wherein said edges of the sheets of the pair of sheets of the respective radiating element are pressed and drawn to form a cold joint of the edges.

* * * * *